US006991271B2

(12) United States Patent
Chiang

(10) Patent No.: US 6,991,271 B2
(45) Date of Patent: Jan. 31, 2006

(54) LATCH ASSEMBLY WITH ADJUSTABLE BACKSET

(75) Inventor: Kuang-Chun Chiang, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/610,569

(22) Filed: Jul. 2, 2003

(65) Prior Publication Data

US 2004/0251697 A1 Dec. 16, 2004

(51) Int. Cl.
*E05C 1/00* (2006.01)

(52) U.S. Cl. ..... 292/1.5; 292/337

(58) Field of Classification Search ..... 292/1.5, 292/337, DIG. 60

See application file for complete search history.

(56) References Cited

U.S. PATENT DOCUMENTS 4,711,477 A * 12/1987 Fann et al. ..... 292/169.14
4,834,432 A * 5/1989 Smallegan et al. .... 292/169.21
4,927,199 A * 5/1990 Wu et al. ..... 292/1.5
5,102,175 A * 4/1992 Wu et al. ..... 292/337
5,647,617 A * 7/1997 Kajuch ..... 292/1.5

* cited by examiner

*Primary Examiner*—Gary Estremsky
(74) *Attorney, Agent, or Firm*—Bacon & Thomas, PLLC

(57) ABSTRACT

A latch assembly includes a lock case, two assembling plates, a latch bolt, a connecting plate, a first cam, and a second cam. The lock case and the assembling plates are connected together for receiving the latch bolt, the connecting plate, and the cams. Each assembling plate includes a first hole and a second hole, with the first holes being aligned with each other and with the second holes being aligned with each other. The connecting plate is connected to the latch bolt and the cams to move therewith. Each cam has a spindle hole. At least one cam has a stop wall that closes the respective spindle hole to form a closed non-circular hole. The spindle holes of the cams are separated by the stop wall, thereby preventing a spindle extending through one of the spindle holes from entering the other spindle hole.

12 Claims, 5 Drawing Sheets

LATCH ASSEMBLY WITH ADJUSTABLE BACKSET

BACKGROUND OF THE INVENTION

1. Field of the Invention

The present invention relates to a latch assembly with adjustable backset. In particular, the present invention relates to a backset-adjustable latch assembly that prevents undesired displacement of a spindle.

2. Description of Related Art

A typical latch Assembly with adjustable backset has been disclosed in, e.g., U.S. Pat. No. 4,615,549. As illustrated in FIGS. 8 through 10 of the drawings which correspond to FIGS. 1 through 3 of U.S. Pat. No. 4,615,549, the dual backset latch includes a lock case (bolt housing) 10, two pulling plates (housing shell halves) 20, a latch bolt 30, a connecting plate (latch operating plate) 40, and front and rear cams 50, 50'. The lock case 10 and the assembling plates 20 together form the main body of the latch assembly. A base portion of the latch bolt 30 extends into the lock case 10. The connecting plate 40 extends through the lock case 10 and between the assembling plates 20, with a front end of the connecting plate 40 being connected to the latch bolt 30 to move therewith. The connecting plate 40 is provided with a pair of rear latch bosses 41 and 42. The assembling plates 20 include two aligned holes 21 and 22. Each cam 50, 50' has a hub portion 51, 51', a rectangular spindle slot 52, 52', and a pair of ears 53, 53'. The cams 50 and 50' are spaced by the connecting plate 40 and rotatably received in the holes 21 and 22, respectively. When either cam 50, 50' is turned, the respective ear 53, 53' presses against the respective latch boss 41, 42, thereby retracting the latch bolt 30 into the lock case 10.

The backset of the front cam 50 is under industry standard 2 and ⅛ inches (or approximately 60 mm) and for the rear cam 50' 2 and ¾ inches (or approximately 70 mm). When the latch assembly is mounted together with other parts of a door lock to a mounting hole in a door, the installer may selectively extend a spindle (not shown) through either one of the spindle slots 52 and 52' respectively of the cams 50 and 50' without adjusting the latch assembly, thereby accomplishing installation.

Although this latch assembly can be used with doors having two standard backset sizes, there are still several drawbacks. Firstly, the spindle holes 52 and 52' respectively of the cams 50 and 50' are substantially slanted U-shaped and communicated with each other such that the spindle extending through, e.g., the spindle hole 52 of the cam 50 is apt to slide into the spindle hole 52' of the cam 50'. The spindle is thus stuck and rotation of either handle (not shown) of the door lock is impossible. Second, the joint area between the two holes 21 and 22 of the respective assembling plate 20 is relatively large such that either cam 50 or 50' may undesirably enter the incorrect hole 22 or 21. As a result, the cams 50 and 50' are stuck in the same hole 21 or 22.

OBJECT OF THE INVENTION

The object of the present invention is to provide a backset-adjustable latch assembly that prevents undesired displacement of a spindle.

SUMMARY OF THE INVENTION

To achieve the aforementioned object, the present invention provides a latch assembly including a lock case, two assembling plates securely mounted to the lock case, a latch bolt received in the lock case and movable between a retracted position and an extended position, a connecting plate extending through the lock case and between the assembling plates, a first cam, and a second cam.

Each assembling plate includes a first hole and a second hole, with the first holes of the assembling plates being aligned with each other and with the second holes of the assembling holes being aligned with each other. The connecting plate is connected to the latch bolt to move therewith. The first cam is received in the first holes of the assembling plates. The first cam has a first spindle hole. The first cam further has a stop wall that closes the first spindle hole to form a closed non-circular hole. The second cam is received in the second holes of the assembling plates. The second cam has a second spindle hole.

The first cam and the second cam are connected to the connecting plate to move therewith such that pivotal movement of either one of the first cam and the second cam causes retraction of the latch bolt. The first spindle hole of the first cam and the second spindle hole of the second cam are separated by the stop wall, thereby preventing a spindle extending through one of the first spindle hole and the second spindle hole from entering the other of the first spindle hole and the second spindle hole.

Other objects, advantages and novel features of this invention will become more apparent from the following detailed description when taken in conjunction with the accompanying drawings.

DETAILED DESCRIPTION OF THE PREFERRED EMBODIMENT

Figure 1:
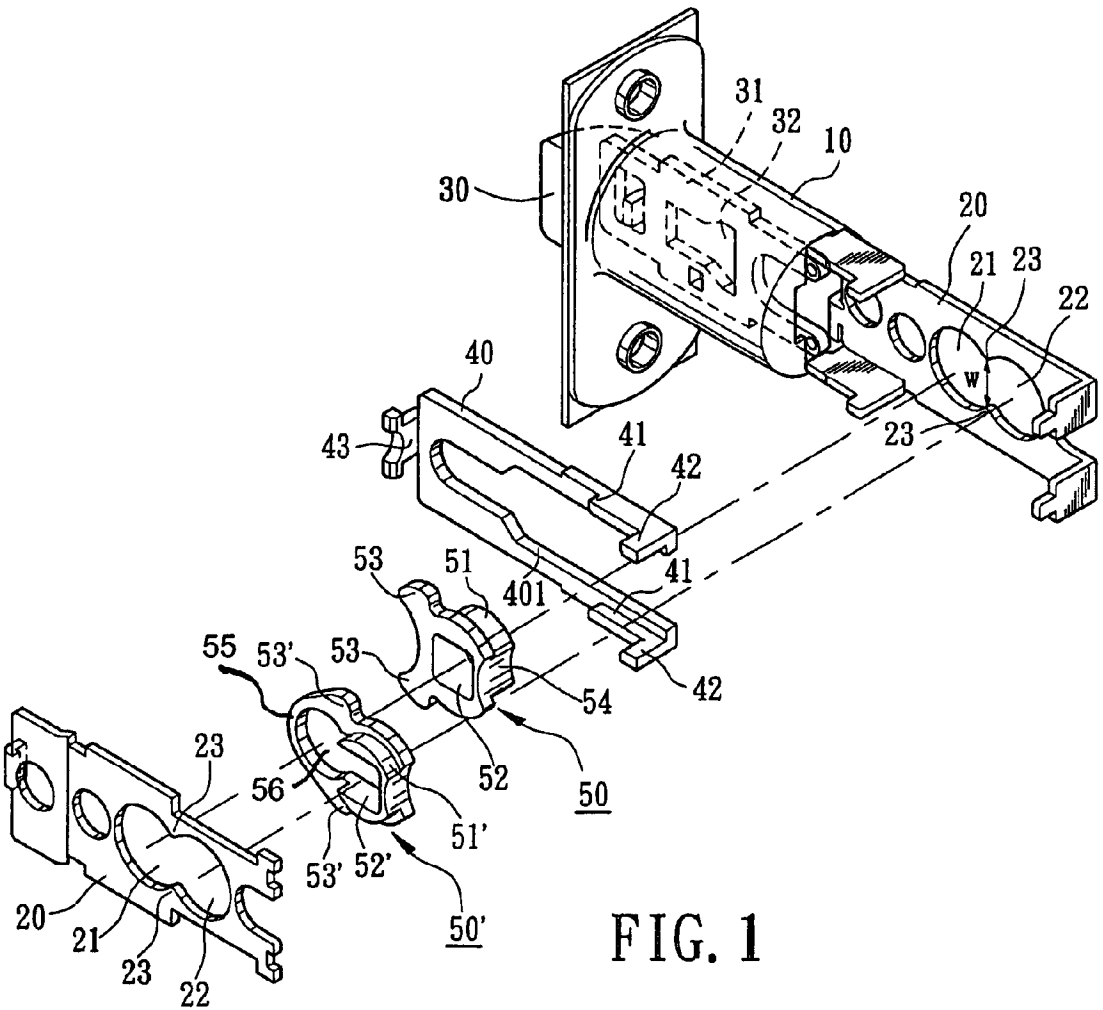
FIG. 1 is an exploded perspective view of a latch assembly in accordance with the present invention.
Figure 2:
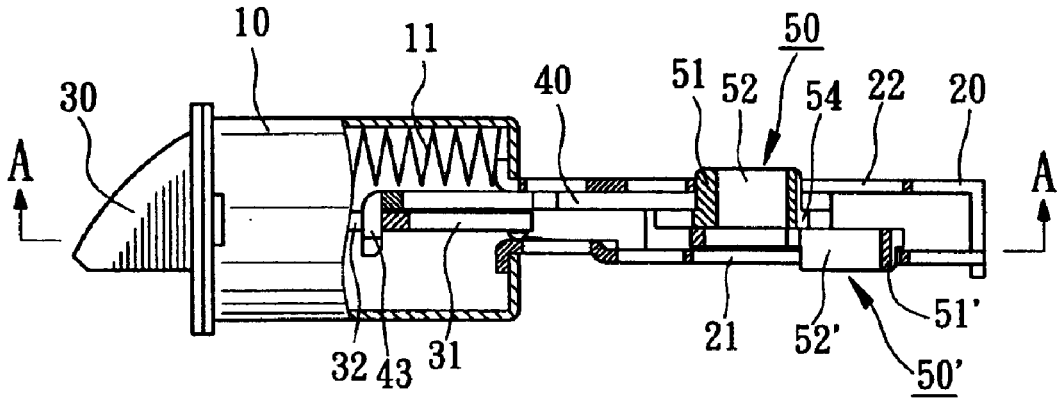
FIG. 2 is a side view, partly sectioned, of the latch assembly in accordance with the present invention.
Figure 3:
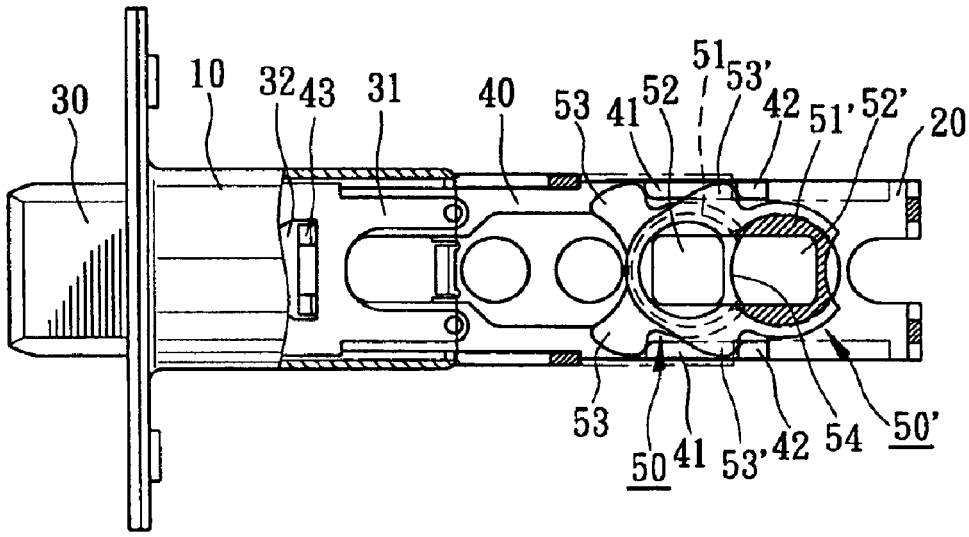
FIG. 3 is a sectional view taken along line A—A in FIG. 2.

Referring to FIGS. 1 through 3, a latch assembly in accordance with the present invention includes a lock case 10, two assembling plates 20, a latch bolt 30, a connecting plate 40, a first cam 50, and a second cam 50'. The lock case 10 and the assembling plates 20 are assembled together by, e.g., fasteners, engaging grooves, engaging slots, etc. to form the main body of the latch assembly. Each assembling plate 20 includes a first hole 21 and a second hole 22, with the first holes 21 being aligned with each other and with the second holes 22 being aligned with each other. The position of a center of the respective first hole 21 corresponds to the backset under industry standard 2 and ⅛ inches (or approximately 60 mm), and the position of a center of the respective second hole 22 corresponds to the backset under industry standard 2 and ¾ inches (or approximately 70 mm). Of more importance, a necked portion 23 is formed between a joint area between the respective first hole 21 and the respective second hole 22. In this embodiment, the necked portion 23 is in the form of two tooth-like structures facing each other.

The latch bolt 30 and an elastic element 11 (FIG. 2) are mounted in the lock case 10. The latch bolt 30 has an end connected to a base plate 31 having a slot 32. The connecting plate 40 extends through the lock case 10 and between the assembling plates 20. The connecting plate 40 has an elongated longitudinal slot 401 for receiving the cams 50 and 50', with a rear end of the connecting plate 40 being bent to form two pairs of protrusions 41 and 42, and with a front end of the connecting plate 40 having a hook 43 that is connected to the latch bolt 30 to move therewith. Thus, reciprocal movement of the latch bolt 30 is allowed when the connecting plate 40 moves.

Still referring to FIGS. 1 through 3, the first cam 50 has a hub portion 51, a first spindle hole 52, at least one ear 53, and a stop wall 54. The second cam 50' has a hub portion 51', a second spindle hole 52', and at least one ear 53'. A reinforcing ring 55 extends between and connects the ears 53' and defines an additional first spindle hole 56 aligned with the first holes 21 of the assembling plates 20. The cams 50 and 50' are spaced by the connecting plate 40. Further, the hub portions 51 and 51' respectively of the first cam 50 and the second cam 50' are rotatably received in the holes 21 and 22. The ear 53, 53' of the respective cam 50, 50' abuts against the respective protrusion 41, 42. When either cam 50, 50' is turned, the respective ear 53, 53' presses against the respective protrusion 41, 42, thereby retracting the latch bolt 30 into the lock case 10. The spindle hole 52 of the first cam 50 can be closed by the stop wall 54 to form a non-circular hole. The spindle hole 52' of the second cam 50' includes a non-circular hole, which is a substantially slanted U-shaped hole with an opening.

Figure 4:
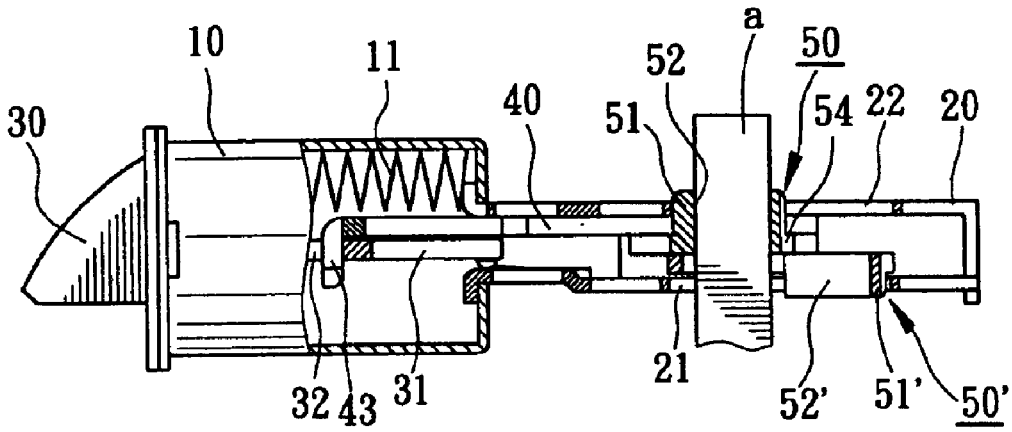
FIG. 4 is a view similar to FIG. 2, wherein a spindle is extended through one of two spindle holes.
Figure 5:
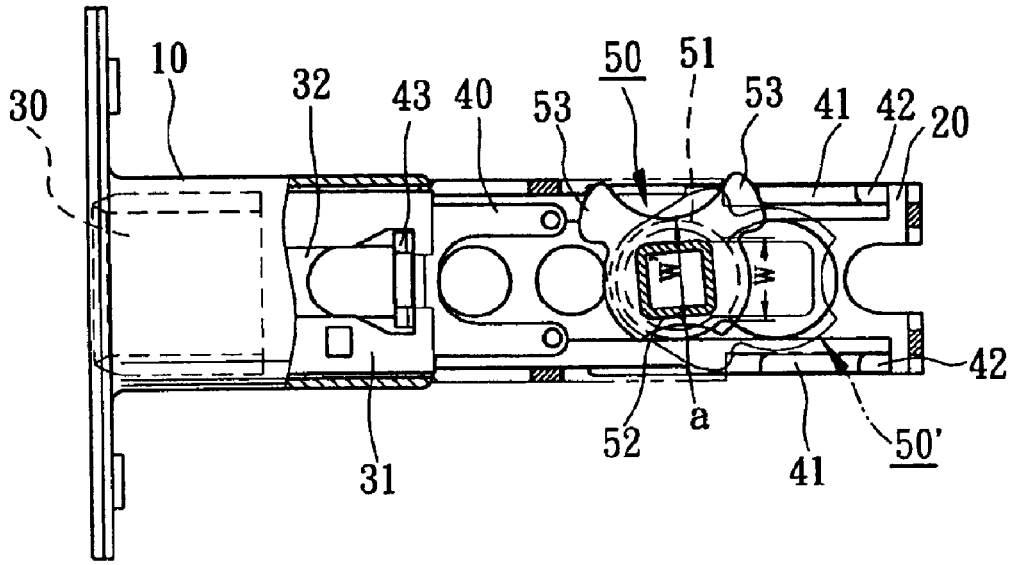
FIG. 5 is a view similar to FIG. 3, wherein a spindle is extended through one of two spindle holes as shown in FIG. 4 and wherein the latch bolt is retracted.

Referring to FIGS. 4 and 5, in a case that a spindle "a" is extended through the spindle hole 52 of the first cam 50, since the spindle hole 52 of the first cam 50 is a non-circular hole closed by the stop wall 54, the stop wall 54 serves to prevent the spindle "a" from entering the spindle hole 52' of the second cam 50' and to prevent the spindle "a" from displacing and getting stuck. Further, since a necked portion 23 (see the width "w" in FIG. 1 that is smaller than the smallest portion of the hub 50 of the cam 50) is provided in the joint area between the respective first hole 21 and the respective second hole 22, the first cam 50 is prevented from entering the respective second hole 22 during rotational movement of the first cam 50. Thus, the first cam 50 is avoided from moving to an improper location and thus getting stuck.

Further, as illustrated in FIG. 5, the stop wall 54 of the first cam 50 is preferably concave to avoid interference with or hindrance to pivotal movement of the second cam 50'. The spindle hole 52 of the first cam 50 is preferably a square hole.

Figure 6:
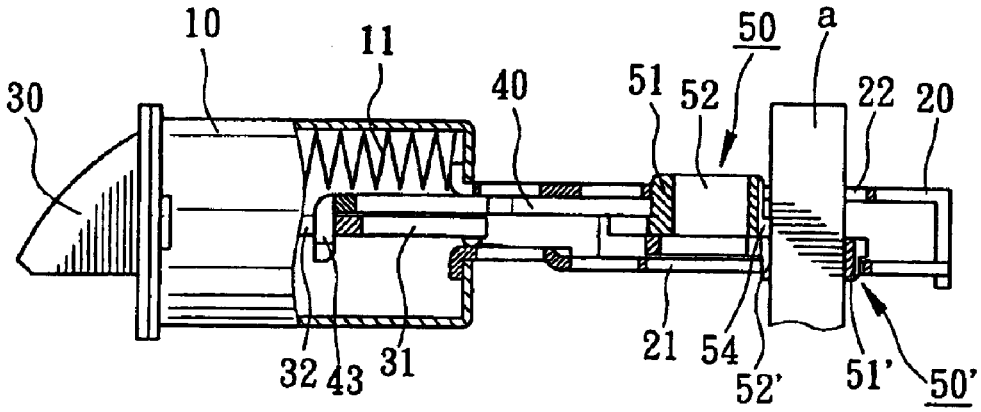
FIG. 6 is a view similar to FIG. 4, wherein the spindle is extended through the other spindle hole.
Figure 7:
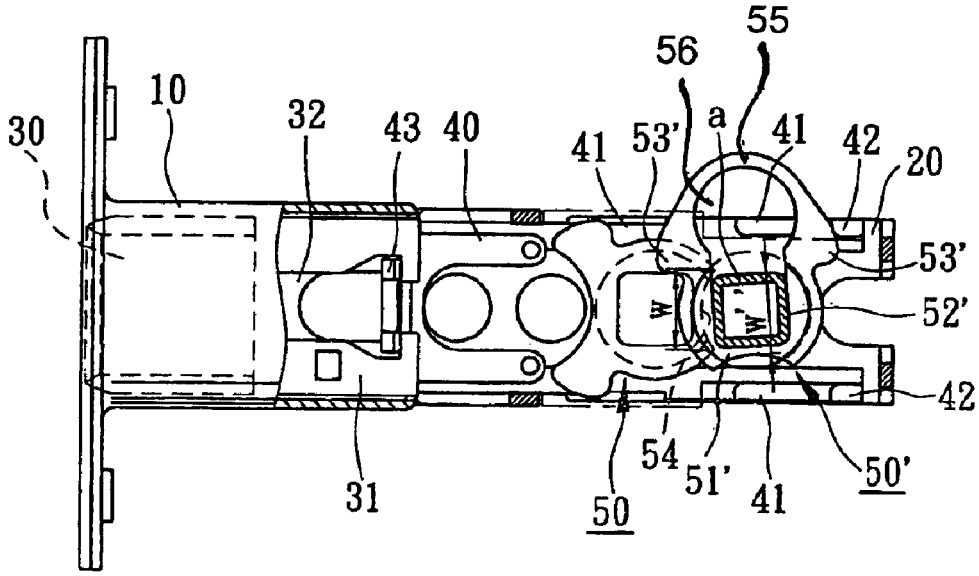
FIG. 7 is a view similar to FIG. 5, wherein the spindle is extended through the other spindle hole and wherein the latch bolt is retracted.

Referring to FIGS. 6 and 7, in a case that the spindle "a" is extended through the spindle hole 52' of the second cam 50', although the spindle hole 52' of the second cam 50' is a substantially slanted U-shaped hole without being delimited by a stop wall, the spindle "a" is retained in the spindle hole 52' by the stop wall 54 of the first cam 50. Thus, the spindle "a" is prevented from entering the spindle hole 52 of the first cam 50 and from getting stuck. Further, since a necked portion 23 (see the width "w" in FIG. 1 that is smaller than the smallest portion of the hub 50' of the cam 50') is provided in the joint area between the respective first hole 21 and the respective second hole 22, the second cam 50' is prevented from entering the respective first hole 21 during rotational movement of the second cam 50'. Thus, the second cam 50' is avoided from moving to an improper location and thus getting stuck.

Further, as illustrated in FIG. 7, the stop wall 54 of the first cam 50 is preferably concave to avoid interference with or hindrance to pivotal movement of the second cam 50'. Alternatively, the second cam 50' may also include a stop wall to close the spindle hole 52'. In another embodiment, each cam 50, 50' has a stop wall 54 that closes the respective spindle hole 52, 52'.

Figure 8:
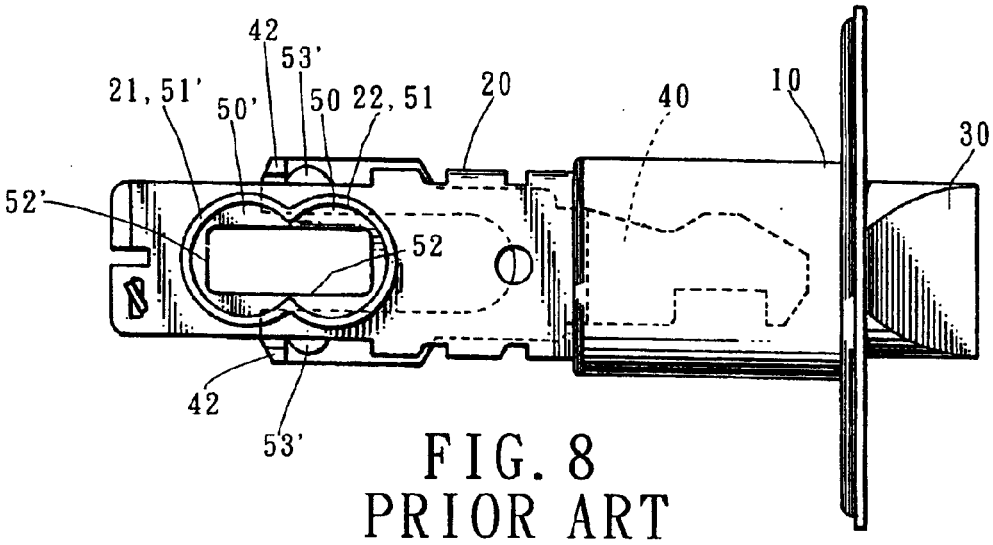
FIG. 8 PRIOR ART
FIG. 8 is a side view of a conventional latch assembly.
Figure 9:
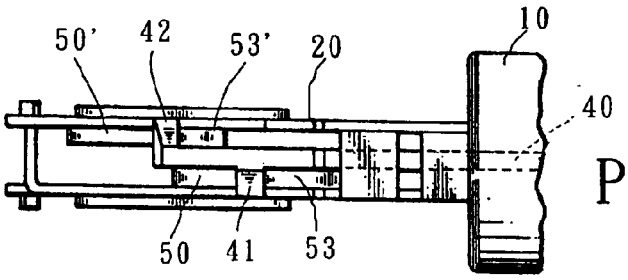
FIG. 9 PRIOR ART
FIG. 9 is a top view of the latch assembly in FIG. 8.
Figure 10:
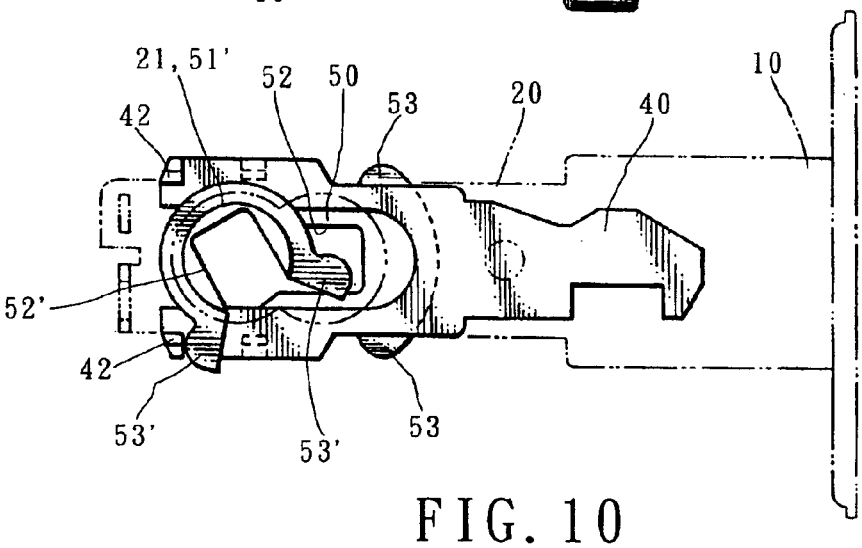
FIG. 10 PRIOR ART
FIG. 10 is a view similar to FIG. 8, illustrating retraction of the latch bolt.

By contrast, the spindle holes 52 and 52' respectively of the cams 50 and 52' are substantially slanted U-shaped holes having openings, and the width "w" in the joint area between the holes 21 and 22 is too large. As a result, the spindle "a" is apt to displace and/or get stuck. The drawbacks of the conventional latch assembly shown in FIGS. 8 through 10 are avoided by the latch assembly shown in FIG. 1. The latch assembly in accordance with the present invention can be used with doors having different backset sizes. Further, the latch assembly provides improved stability in use through the provision of the stop wall 54 and the necked portion 23.

While the principles of this invention have been disclosed in connection with its specific embodiment, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A latch assembly comprising:

a lock case;

two assembling plates securely mounted to said lock case, each said assembling plate including a first hole and a second hole, with said first holes of said assembling plates being aligned with each other and with said second holes of said assembling holes being aligned with each other;

a latch bolt received in the lock case and movable between a retracted position and an extended position;

a connecting plate extending through the lock case and between said assembling plates, said connecting plate being connected to said latch bolt to move therewith;

a first cam received in said first holes of said assembling plates, said first cam having a first spindle hole, and said first cam further having a stop wall that closes said first spindle hole to form a closed non-circular hole; and a second cam received in said second holes of said assembling plates, said second cam having a second spindle hole, at least one ear, and a reinforcing ring, said connecting plate including a protrusion on at least one side thereof, said at least one ear of said second cam abutting against said protrusion of said connecting plate for retracting said latch bolt, said reinforcing ring defining an additional spindle hole extending from said second spindle hole and aligned with said first holes of said assembling plates, and said reinforcing ring being connected to said ear of said second cam for reinforcement;

said first cam and said second cam being connected to said connecting plate to move therewith such that pivotal movement of either one of said first cam and said second cam causes retraction of said latch bolt;

said first spindle hole of said first cam and said second spindle hole of said second cam being separated by said stop wall, thereby preventing a spindle extending through one of said first spindle hole of said first cam and said second spindle hole of said second cam from entering the other of said second spindle hole of said second cam and said first spindle hole of said first cam.

2. The latch assembly as claimed in claim 1, wherein said first cam includes a hub portion rotatably received in said first spindle hole.

3. The latch assembly as claimed in claim 1, wherein said second cam includes a hub portion rotatably received in said second spindle hole.

4. The latch assembly as claimed in claim 2, wherein a necked portion is formed in a joint area between the respective first hole and the respective second hole, said necked portion having a width smaller than that of the smallest portion of said first cam.

5. The latch assembly as claimed in claim 3, wherein a necked portion is formed in a joint area between the respective first hole and the respective second hole, said necked portion having a width smaller than that of the smallest portion of said second cam.

6. The latch assembly as claimed in claim 1, wherein said first cam includes at least one ear, said connecting plate including a protrusion on at least one side thereof, said at least one ear of said first cam abutting against said protrusion of said connecting plate for retracting said latch bolt.

7. The latch assembly as claimed in claim 1, wherein said stop wall is concave.

8. The latch assembly as claimed in claim 1, wherein said non-circular hole delimited by said stop wall is a square hole.

9. The latch assembly as claimed in claim 1, wherein said second cam further comprises a second said ear such that said reinforcing ring extends between said ears for reinforcement.

10. The latch assembly as claimed in claim 9, wherein said connecting plate includes a pair of protrusions corresponding to said ears of said second cam such that said ears of said second cam abut against said protrusions of said connecting plate for retracting said latch bolt.

11. The latch assembly as claimed in claim 1, wherein said ear of the second cam is disposed on a periphery of the second cam located between said additional spindle hole and said second spindle hole.

12. The latch assembly as claimed in claim 1, wherein a neck portion is formed between said additional spindle hole and said second spindle hole of the second cam.

* * * * *